US005486418A

United States Patent [19]

Ohmory et al.

[11] Patent Number: 5,486,418

[45] Date of Patent: Jan. 23, 1996

[54] WATER-SOLUBLE HEAT-PRESS-BONDING POLYVINYL ALCOHOL BINDER FIBER OF A SEA-ISLANDS STRUCTURE

[75] Inventors: Akio Ohmory; Tomoyuki Sano; Masahiro Satoh, all of Kurashiki; Syunpei Naramura, Kiyone; Satoru Kobayashi, Kurashiki; Yosuke Sekiya, Hayashima, all of Japan

[73] Assignee: Kuraray Co., Ltd., Okayama, Japan

[21] Appl. No.: 322,424

[22] Filed: Oct. 13, 1994

[30] Foreign Application Priority Data

Oct. 15, 1993 [JP] Japan ..... 5-258117

[51] Int. Cl.[6] ..... D02G 3/04

[52] U.S. Cl. ..... 428/397; 428/296; 428/373; 428/374; 428/375; 428/376; 428/378; 428/393; 428/394; 428/398; 428/399; 428/400; 428/401

[58] Field of Search ..... 428/296, 373, 428/374, 375, 376, 378, 393, 394, 397, 398, 399, 400, 401

[56] References Cited

U.S. PATENT DOCUMENTS

| | | | |
|---|---|---|---|
| 4,140,668 | 2/1979 | Sumi et al. | 260/33.2 R |
| 5,124,194 | 6/1992 | Kawano | 428/224 |
| 5,208,104 | 5/1993 | Ueda et al. | 428/364 |
| 5,238,995 | 8/1993 | Fukunishi et al. | 525/60 |

FOREIGN PATENT DOCUMENTS

| | | |
|---|---|---|
| 0351046 | 1/1990 | European Pat. Off. . |
| 41-6605 | 4/1966 | Japan . |
| 47-29579 | 8/1972 | Japan . |
| 47-31376 | 8/1972 | Japan . |
| 47-42050 | 10/1972 | Japan . |
| 51-87542 | 7/1976 | Japan . |
| 51-28729 | 8/1976 | Japan . |
| 53-50239 | 5/1978 | Japan . |
| 1-260017 | 10/1989 | Japan . |

OTHER PUBLICATIONS

Abstract of JP–62028408, Norihisa et al., "Polyvinyl Alcohol Based Synthetic Fiber Having Solubility and Low Shrinkage", Feb. 6, 1987.

Abstract of JP–3213544, Yutaka et al., "Bulky Clothes–Wadding", Sep. 18, 1991.

Abstract of JP–59059919, Kimiyoshi et al., "Staple Fiber for Binder", Apr. 5, 1984.

*Primary Examiner*—George F. Lesmes
*Assistant Examiner*—Kathleen L. Choi
*Attorney, Agent, or Firm*—Wenderoth, Lind & Ponack

[57] ABSTRACT

By mixing a high-melting polyvinyl alcohol type polymer (A) and a low-melting water-soluble polymer (B) in a solvent for the polymer (A) to prepare a spinning solution and then subjecting the solution to low-temperature spinning so that the resulting filaments are solidified uniformly in the cross-sectional direction, there is formed a fiber of sea-islands structure comprising said high-melting polyvinyl alcohol type polymer (A) as the sea component and said low-melting water-soluble polymer (B) as the islands component. In this fiber, at least part of the islands component is present in a fiber zone ranging from the fiber surface to 2 μm inside and the fiber surface contains substantially no islands component. This fiber ordinarily shows the performance of the matrix phase, i.e. the performance of a high-melting polyvinyl alcohol fiber; however, when the fiber is pressurized at high temperatures, the low-melting polymer (the islands component) is pushed out onto the fiber surface and there occurs heat bonding between fibers. Owing to this property of the fiber, a nonwoven fabric can be produced advantageously from the fiber.

8 Claims, 1 Drawing Sheet

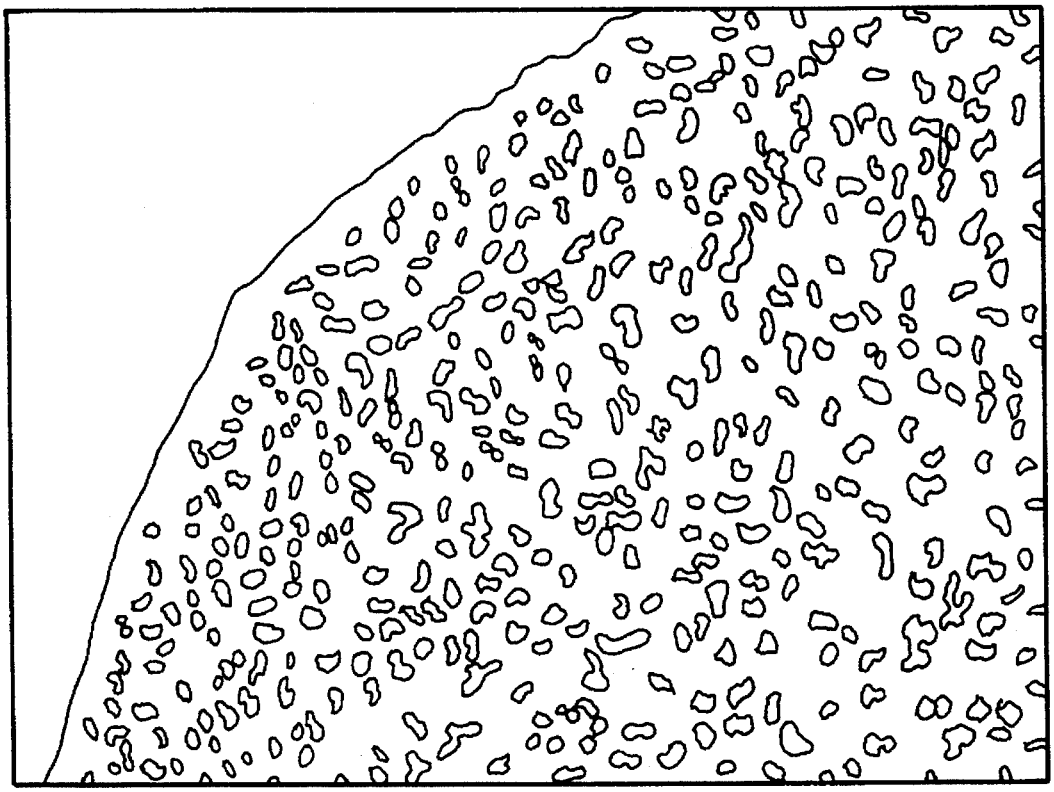
x20,000
1 μm

WATER-SOLUBLE HEAT-PRESS-BONDING POLYVINYL ALCOHOL BINDER FIBER OF A SEA-ISLANDS STRUCTURE

BACKGROUND OF THE INVENTION

1. Field of the Invention

The present invention relates to a water-soluble heat-press-bonding polyvinyl alcohol type (hereinafter referred to simply as PVA type) binder fiber. More particularly, the present invention relates to a PVA type binder fiber which is heat-press-bondable, small in dimensional change of fiber during heat-press bonding, and water-soluble even after heat-press bonding; a process for production of said fiber; and a nonwoven fabric using said fiber.

2. Description of the Prior Art

Heat-bonding binder fibers made from, for example, a melt-spinnable polyethylene or polyester are on the market. Recently, a sheath-core bicomponent type heat-bonding binder fiber comprising a high-melting-point (hereinafter referred to simply as high-melting) polymer as the core and a low-melting-point (hereinafter referred to simply as low-melting) polymer as the sheath has been developed, and this has made it possible to suppress the shrinkage of fiber during heat bonding. The sheath-core bicomponent type heat-bonding binder fiber is finding wider applications owing to its merits such as easy and speedy bonding operation, no public hazard and the like.

These heat-bonding binder fibers, however, are each made from a hydrophobic resin and therefore have low bondability to hydrophilic resins such as PVA type resin, cellulose type resin and the like. Further, these heat-bonding binder fibers are not water-soluble, of course.

In producing a water-soluble nonwoven fabric, there has been used a process which comprises imparting an aqueous solution of a water-soluble resin of PVA type to a web of a water-soluble fiber of PVA type and then drying the resulting web at low temperatures for a long time to give rise to fixing between fibers. For example, in producing a chemical lace base fabric which must be water-soluble, there is generally used a process which comprises coating or impregnating a dry laid nonwoven fabric made from a water-soluble PVA fiber, with an aqueous solution of a PVA type resin and then drying the resulting fabric. In such a process of imparting an aqueous solution and then drying the resulting material, however, the water-soluble fibers of the base fabric cause swelling because of the imparting of an aqueous solution thereto and, when the drying temperature is high, dissolve in the aqueous solution, which causes the deformation of nonwoven fabric; therefore, the drying must be conducted at low temperatures, which requires a long drying time and results in low productivity. Incidentally, the above-mentioned "chemical lace base fabric" is a water-soluble fabric or nonwoven fabric used as a base for production of lace. When mechanical embroidery is made on the base fabric with a water-insoluble thread and then the base fabric is dissolved and removed by an aqueous treatment, the embroidery remains in the form of lace.

Development of a heat-bonding water-soluble fiber allows for fixing between fibers by heat bonding and enables high productivity. In producing a base fabric for wet wiper, for example, by bonding the fibers of a cellulose base material by the use of a heat-bonding polyolefin type fiber, the product of inferior quality or the refuses from trimming all appearing during the production of said base fabric are not recoverable and therefore are disposed by incineration; in this case, if the heat-bonding fiber is water-soluble, the product of inferior quality or the refuses from trimming are recoverable because the bonded fibers can be disintegrated simply by washing with water.

All of conventionally known heat-bonding fibers are produced from a melt-spinnable hydrophobic polymer, and no fiber is known yet which has both water solubility and heat bondability and yet has fiber properties capable of withstanding the conditions of actual use. For example, a PVA type polymer, which is a typical water-soluble polymer, has a strong interaction between molecules owing to the hydroxyl groups in the molecule, has a melting point close to the thermal decomposition temperature, and is generally impossible to melt without causing thermal decomposition; therefore, it is generally impossible to produce a heat-bonding fiber from said PVA polymer.

Under such a circumstance, it was proposed to allow a PVA type polymer to have a lower melting point or a lower softening point for enabling its melt molding or for using it as a hot-melt adhesive, by applying, to the PVA type polymer, a means such as internal plasticizatin (by copolymerization modification or post-reaction modification) or external plasticization (by plasticizer addition). Water-soluble hot-melt PVA type adhesives are disclosed in, for example, Japanese Patent Application Kokai (Laid-Open) No. 87542/1976, U.S. Pat. No. 4140668 and Japanese Patent Application Kokai (Laid-Open) No. 50239/1978. Each of these hot-melt PVA type polymers, however, has a low polymerization degree of 600 or less so as to be able to give a melt of low viscosity and high adhesivity and therefore has a very low spinnability. Moreover, each of the resulting fibers, when used as a heat-bonding fiber, shows high shrinkage because the oriented molecules in fiber melt and relax during heat bonding; therefore, each fiber is difficult to put into actual use.

In Japanese Patent Publication No. 29579/1972 and Japanese Patent Publication No. 42050/1972, it is described that a fiber obtained by wet spinning of a mixture of a PVA solution with an ethylene-vinyl acetate copolymer emulsion is heat-sealable and can be used as a binder fiber or base fiber for paper or nonwoven fabric. In this technique, however, said emulsion to be mixed with a PVA solution must be an emulsion of a water-in-soluble polymer. Since a water-soluble polymer cannot be made into an emulsion, the above technique is unable to produce a water-soluble fiber.

In Japanese Patent Publication No. 6605/1966 and Japanese Patent Publication No. 31376/1972, it is described that an easily fibrillatable fiber is produced by mix-spinning a completely saponified PVA having a saponification degree of 99.5 mole % or more and a partially saponified PVA. In these prior arts, it is intended to produce an easily fibrillatable fiber; therefore, a highly water-resistant completely saponified PVA is used as one component, there are carried out drawing, heat shrinkage and, an necessary, acetalization and, as a result, the resulting fiber is not water-soluble. Further, in these prior arts, there is used a dehydration coagulation method employing an aqueous Glauber's salt solution as a coagulation bath, which is an ordinary spinning method used for vinylon; in this dehydration coagulation method, however, there is formed a fiber of nonuniform cross section having an obvious skin-core structure. Moreover in the dehydration coagulation method, it is difficult to spin a partially saponified PVA having a saponification degree of 85 mole % or less and, when the resulting fiber is subjected to washing with water in order to remove the Glauber's salt adhereing onto the fiber surface, the fiber surface dissolves in the water used for washing and there occurs fusion between filaments. For this reason, it is actually impossible in the prior arts to use a partially saponified PVA having a saponification degree of 85% or less and conduct mix-spinning. In fact, all Examples use, as the partially saponified PVA, PVAs having a saponification degree of 88 mole % or more.

In Japanese Patent Publication No. 28729/1976, it is described that a self-adhering synthetic pulp is produced by dissolving a PVA, a polyacrylonitrile and an acrylonitrile-grafted PVA in dimethyl sulfoxide (hereinafter referred to simply as DMSO) (DMSO is a common solvent for said three polymers), subjecting the solution to wet spinning, drawing the resulting fiber, and subjecting the drawn fiber to beating. In such a technique, however, no water-soluble fiber is obtainable, of course.

In Japanese Patent Application Kokai (Laid-Open) No. 5318/1977, it was proposed to produce an ultra-fine fiber by mix- or bicomponent-spinning a PVA of low polymerization degree and low saponification degree and a polymer having a fiber formability and then washing the resulting filaments with water to remove the PVA of low polymerization degree and low saponification degree. Since the polymer having a fiber formability is a water-insoluble polymer not affected by the above water treatment, no water-soluble fiber is obtainable by the above technique.

In Japanese Patent Application Kokai (Laid-Open) No. 260017/1989, there was proposed a high-strength water-disintegratable PVA type bicomponent fiber comprising, as the core component, a PVA type polymer having a saponification degree of 80–95 mole % and, as the sheath component, a PVA type polymer having a saponification degree of 96 mole % or more. This bicomponent fiber, unlike the binder fiber of the present invention, basically has a core-sheath structure in which the core is present as one core and the surface layer consists of a thick layer of a high-melting polymer, and therefore is unusable as a heat-bonding fiber.

In European Patent No. 351046, there is described a process for producing a highly-water-resistant high-shrinkage PVA type fiber by mix-spinning a PVA and a polymer capable of crosslinking with the PVA (e.g. a polyacrylic acid) and then subjecting the resulting fiber to a crosslinking reaction. The fiber obtained by this process causes breaking in water of 100° C. or less because the uncrosslinked portions of the fiber dissolve in the water. However, the crosslinked portions of the fiber are insoluble in the water.

It is strongly desired in the art to develop a PVA type binder fiber which has both heat bondability and water-solubility and which has fiber properties capable of withstanding the conditions of actual use. Such a binder fiber, however, has been unobtainable with conventional techniques.

SUMMARY OF THE INVENTION

Hence, an object of the present invention is to produce a PVA type binder fiber which is water-soluble and heat-bondable and which has fiber properties (e.g. tensile strength) capable of withstanding the conditions of actual use.

Other object of the present invention is to produce a process for producing such a binder fiber, as well as a nonwoven fabric containing such a binder fiber and a process for producing such a nonwoven fabric.

The present inventors made an extensive study in order to achieve the above objects and, as a result, has completed the present invention. According to the present invention, there is provided a water-soluble heat-press-bonding PVA type binder fiber of sea-islands structure, having a complete-water-dissolution temperature of 100° C. or less and a tensile strength of 3 g/d or more, in which structure the sea component is a water-soluble PVA type polymer (A) and the islands component is a water-soluble polymer (B) having a melting point or a fusion-bonding temperature each at least 20° C. lower than the melting point of the polymer (A), and in which fiber at least part of the islands component is present in a fiber zone from 0.01 to 2 μm inside from the fiber surface.

BRIEF DESCRIPTION OF THE DRAWING

The drawing illustrates a fiber of the present invention having a sea-islands structure wherein the art line shown in the left hand corner of the drawing represents the periphery of the fiber, and the fiber itself illustrates the fine and innumerable island components which exist in the fiber of the present invention.

DETAILED DESCRIPTION OF THE INVENTION

The binder fiber of the present invention is a multicomponent fiber having a sea-islands structure. As the matrix, i.e. the sea component, which must have a sufficient fiber formability and practical fiber properties and moreover be water-soluble, there is used a water-soluble PVA type polymer (A). The water-soluble PVA type polymer (A) preferably has a melting point of 200° C. or more. The present binder fiber, when using, as the sea component, a polymer (A) having a melting point of less than 200° C., tends to have slightly lower heat resistance and handleability under high humidity. Thus, a polymer (A) having a melting point of 210° C. or more is particularly preferable. The melting point of the polymer (A) has no particular upper limit but is preferably 230° C. or less in view of the hot-water solubility and heat-press bondability of the polymer (A). A polymer (A) having a melting point of 225° C. or less is particularly preferable because the binder fiber using said polymer (A) as the sea component tends to have lower heat-press-bonding temperature and water-dissolution temperature.

Specific examples of the PVA type polymer (A) usable as the sea component include a high saponification degree PVA having a polymerization degree of 500–24,000 and a saponification degree of 90.0–99.0 mole %. A PVA having a polymerization degree of 1,500–4,000 and a saponification degree of 93.0–98.5 mole % is more preferable in view of the hot-water solubility and heat-press bondability. The specific examples also include PVAs modified with a modifying unit such as ethylene, allyl alcohol, itaconic acid, acrylic acid, maleic anhydride or ring-opening product thereof, arylsulfonic acid, aliphatic vinyl ester whose aliphatic acid moiety has 4 or more carbon atoms (e.g. vinyl pivalate), vinylpyrrolidone, partial or complete neutralization product of said carboxylic acid or the like. The amount of the modifying unit is preferably 0.1–3 mole %, particularly preferably 0.2–2.0 mole %. The method for introducing the modifying unit has no particular restriction and can be copolymerization or a post-reaction. The distribution of the modifying unit has no particular restriction, either, and can be a random distribution or a block distribution. A block copolymer shows lower hindrance for crystallization than a random copolymer when they have the same modification degree. Consequently, a block copolymer can have a high melting point even when it has a higher modification degree than a random copolymer. The binder fiber of the present invention can have properties close to those of a high-melting polymer alone, by forming its continuous phase (sea or matrix) with a high-saponification degree and high-melting PVA type polymer, and can prevent fusion between filaments in fiber production process by forming its outermost layer with a high-melting polymer.

The islands component in the binder fiber of the present invention consists of a water-soluble polymer (B) having a melting point or a fusion-bonding temperature each at least 20° C. lower than the melting point of the polymer (A). The polymer (B) must be a polymer which causes substantially no crosslinking with the polymer (A) during fiber production process. When the polymer (B) causes said crosslinking, the resulting fiber has no complete solubility in water of 100° C. and, when used, for example, as a chemical lace base fabric, cannot be dissolved in hot water and removed. When the melting point or fusion-bonding temperature of the islands component polymer (B) is higher than the temperature 20° C. lower than the melting point of the sea component polymer (A), the orientation and crystallization of the sea component polymer (A) tends to be destroyed during heat-press bonding. Incidentally, the above fusion-bonding temperature is a minimum temperature at which when chips of a water-soluble amorphous polymer having no melting point are heated at a given temperature and a pressure of 0.1 $kg/cm^2$ is applied thereto for 10 minutes, the chips fusion-bond to each other. In the case of a water-soluble amorphous polymer, this fusion-bonding temperature is regarded as the melting point of said polymer for convenience. Any water-soluble amorphous polymer having a melting point at least 20° C. lower than the melting point of the polymer (A), can be used effectively as the water-soluble polymer (B) in the present invention. More preferably, the water-soluble polymer (B) has a melting point or a fusion-bonding temperature (these are hereinafter referred generically to as melting point, for convenience) at least 25° C. lower than the melting point of the polymer (A). Particularly preferably, the water-soluble polymer (B) has a melting point of 190° C. or less. In the binder fiber of the present invention, the low-melting polymer must be present in the form of an islands component because when the low-melting polymer is present on the outermost surface of fiber, there tends to occur fusion between filaments during fiber production process or during fiber storage under high humidity. Of course, the polymer (B) must be solid at standard conditions, preferably at 50°C.

Specific examples of the water-soluble polymer (B) usable as the islands component in the present invention are PVAs of low saponification degree; cellulose derivatives such as methyl cellulose, hydroxy cellulose and the like; natural polymers such as chitosan and the like; and water-soluble polymers such as polyethylene oxide, polyvinylpyrrolidone and the like. Particularly preferable are low-saponification degree PVAs having a saponification degree of 50–92 mole % and a polymerization degree of 50–4,000 and PVAs modified by 3–10 mole % with a modifying unit such as allyl alcohol, arylsulfonic acid, vinylpyrrolidone or the like, in view of the handleability (particularly under high humidity), adhesivity, properties reproducibility (stability) and cost of the resulting fiber. The method for introduction of the modifying unit has no particular restriction and can be copolymerization or a post-reaction. The distribution of the modifying unit has no particular restriction, either, and can be a random distribution or a block distribution. When the water-soluble polymer (B) is a PVA having a saponification degree of 65 mole % or less, the PVA is preferably modified slightly with the above modifying unit in order to have improved water solubility at high temperatures. The polymerization degree of the islands component polymer has no particular restriction, but is preferably such a low polymerization degree as to provide good fluidity during heat-press bonding, for example, a polymerization degree of 100–1,000 because the islands component is required to contribute not to the strength of fiber but to the adhesivity of fiber. A water-soluble polymer having carboxylic acid group(s) which easily cause(s) a crosslinking reaction with the hydroxyl groups of PVA, for example, a polyacrylic acid is not preferable because it causes a crosslinking reaction with the PVA under ordinary conditions of fiber production and thereby the PVA becomes a water-insoluble polymer. Even a water-soluble polymer having carboxylic acid group(s) can be used in the present invention if it causes substantially no crosslinking reaction under conditions of fiber production.

The mixing ratio of the sea component (A) and the islands component (B) in the sea-islands structure fiber of the present invention is preferably 98/2 to 55/45 in terms of weight ratio. When the proportion of the sea component, i.e. the high-melting PVA type polymer (A) is less than 55%, there is obtained no fiber having a practical strength. When the proportion of the polymer (A) is less than 55% and the proportion of the low-melting water-soluble polymer (B) is more than 45%, the polymer (B) tends to become a sea component and there tends to arise fusion between filaments. Meanwhile, when the proportion of the low-melting water-soluble polymer (B) is less than 2%, there is obtained no heat-press bondability capable of withstanding the conditions of actual use. In view of the balance of strength and heat-press bondability, the weight ratio of the sea and the islands is more preferably 95/5 to 60/40, particularly preferably 92/8 to 70/30.

In the sea-islands structure fiber of the present invention, at least part of the islands component (B) must be present in a fiber zone 0.01–2 μm inside from the fiber surface. When all of the islands component (B) is present distantly from the fiber surface by more than 2 μm and is in the center portion of fiber cross section, the thickness of the sea component phase is large and resultantly the low-melting polymer (B) is unlikely to be pushed out onto the fiber surface during heat-press bonding, making it impossible to obtain sufficient heat-press bondability. Meanwhile, when the islands component (B) is present within 0.01 μm from the fiber surface, the adhesive component is substantially exposed on the fiber surface and there tends to arise fusion between filaments. In the binder fiber of the present invention, therefore, it is preferable that the islands component (B) is not substantially exposed on the fiber surface.

In the binder fiber of the present invention, when the number of islands present in the cross section of fiber is at least 5, the islands component can easily be present in a fiber zone 0.01–2 μm inside from the fiber surface. Hence, a multicore type core-sheath bicomponent fiber having at least 5 islands in the cross section of fiber is a preferred embodiment of the fiber of the present invention. The number of islands is preferably at least 50, more preferably at least 200. However, it is extremely difficult to obtain, by bicomponent spinning, a multicomponent type core-sheath bicomponent fiber having at least 50 islands, in an ordinary fineness (1–5 deniers) because the structure of the spinneret used becomes very complicated. Meanwhile in the mix-spinning using, as the spinning solution, a mixture of the sea component and the islands component, the number of islands can easily be made at least 50 by controlling the state of phase separation in the spinning solution. The islands component may be distributed uniformly in the fiber cross-sectional direction, but is preferably concentrated in a fiber zone close to the fiber surface. Further, the islands component may be continuous in the fiber axial direction, but need not necessarily be continuous and may be in the shape of spheres, rugby balls or thin and long bars.

The binder fiber of the present invention has a tensile strength of 3 g/dr or more. A fiber having a strength of less than 3 g/dr is unsuitable for production of, for example, a chemical lace base fabric. The reason is that while an embroidery needle must be stick into a chemical lace base fabric at a high density in order to obtain a lace of fine design, skip stick occurs and no lace of intended design is obtained when the strength of each single filament of base fabric is less than 3 g/dr. A fiber strength of 3 g/dr or more is also required in order to produce a base fabric of low weight per unit area. A base fabric of low weight per unit area is soft and has excellent handleability and drapeability, and therefore is useful for efficient production of a high-quality lace. Further, a strong fiber and consequently a strong base fabric lead to a higher production speed of base fabric and consequently a higher production speed of lace. A strong fiber has a merit also when mixed with a cellulose base material in the form of a base fabric for wet wiper, because the amount of such a fiber used can be smaller. The fiber of the present invention exhibits its function by being heat-press bonded. It is important that the present fiber maintains a sufficient strength after heat-press bonding even when the fiber undergoes slight deterioration in strength owing to the heat during the heat-press bonding; hence, the present fiber must have a high strength before heat-press bonding. The tensile strength of the present fiber is preferably 4 g/dr or more, more preferably 5 g/dr or more, particularly preferably 7 g/dr or more.

Unlike conventional heat-bonding bicomponent fibers composed of hydrophobic polymers, each of which comprises a high-melting polymer as the core and a low-melting polymer as the sheath, the binder fiber of the present invention comprises, as mentioned above, a high-melting polymer as the sea component and a low-melting polymer as the islands component. In the present binder fiber, there are exhibited, under ordinary conditions, the excellent fiber properties possessed by the high-melting PVA type polymer of high orientation and high crystallization. However, when the present fiber is exposed to heat and pressure (a high temperature and a high pressure), the outermost layer of the high-melting PVA type polymer phase is broken; as a result, the heat-bonding low-melting water-soluble polymer present in the form of islands in a zone close to the fiber surface is pushed out onto the fiber surface and comes to bond to (a) the water-soluble polymer (islands component) of other fibers, pushed out onto the surfaces of the other fibers, or to (b) the high-melting polymer (sea component) of other fibers. The binder fiber of the present invention, whose matrix phase consists of a high-melting PVA type polymer of high orientation and high crystallization, has a high strength and excellent dimensional stability even under high humidity although the islands component consists of a low-melting water-soluble polymer of low saponification degree and low water resistance. Moreover, the matrix phase of the present fiber is not much influenced by heat and pressure. The present fiber, therefore, is small in dimensional change and can maintain a high strength even after heat-press bonding.

In the present invention, heat-press bonding refers to fiber-to-fiber bonding at a temperature of 80° C. or more at a linear pressure of 1 kg/cm or more or an areal pressure of 2 kg/cm$^2$ or more. When the heat-press bonding is conducted at a temperature of less than 80° C. at a linear pressure of less than 1 kg/cm or an areal pressure of less than 2 kg/cm$^2$, the fiber-to-fiber adhesivity obtained is low because the outermost layer of the high-melting PVA type polymer phase is not broken and the low-melting water-soluble polymer present as the islands component in a zone close to the fiber surface is not pushed out onto the fiber surface. When the high-melting polymer of the outermost layer is heated and becomes soft and, in this state, an appropriate pressure is applied, the outermost layer (part of the high-melting polymer phase) is broken and the low-melting polymer is pushed out from inside and functions as an adhesive. The heat-pressing temperature must not be 240° C. or more because when it is too high, the molecular orientation and crystallization of the sea component may be destroyed. An appropriate heat-press bonding temperature differs depending upon the kinds and distributions of the sea component and the islands component, the level of pressure applied, etc. but is preferably 100°–220° C., more preferably 120°–210° C. Too high an applied pressure is not preferable because it destroys the fiber structure of the sea component polymer, resulting in low fiber strength after heat-press bonding. Incidentally, the heat-pressing temperature mentioned herein refers not to a set temperature of hot calender roll but to a fiber temperature to which the fiber itself is heated actually. The linear pressure given by a hot calender roll or the like is preferably 200 kg/cm or less, more preferably 100 kg/cm or less, particularly preferably 60 kg/cm or less. The areal pressure given by a hot press or the like is preferably 400 kg/cm$^2$ or less, more preferably 200 kg/cm$^2$ or less, particularly preferably 100 kg/cm$^2$ or less. A linear pressure of 5–50 kg/cm or an aeral pressure of 10–100 kg/cm$^2$ is used ordinarily. The heat-pressing time can be as low as even about 0.01–10 seconds. Being able to conduct bonding in a short time is a very important merit of heat-press bonding. In the case of the present fiber, a heat-pressing time of 10 minutes or more tends to produce a reduced adhesivity. The reason is not made clear yet but is presumed to have a connection with the crystallization of fiber polymer. Hence, use of a hot calender roll of linear pressure type (gives a shorter treatment time) is preferred for heat-press bonding to use of a hot press of areal pressure type (gives a longer treatment time).

Next, description is made on the process for producing the binder fiber of the present invention.

The high-melting PVA type polymer (A) and the low-melting water-soluble polymer (B) both mentioned above are dissolved in a solvent at a ratio of 98/2 to 55/45 to prepare a spinning solution. The solvent mentioned herein must be a solvent capable of dissolving at least the high-melting PVA type polymer (A). The solvent is preferably a common solvent capable of dissolving even the low-melting water-soluble polymer (B) but, even if it is incapable of dissolving the polymer (B), it is usable if it can disperse the polymer (B) in a solution of the polymer (A) in a size of 10 μm or less, preferably 5 μm or less, more preferably 1 μm or less. Dissolution of the two polymers in a common solvent does not necessarily produce a uniform transparent solution depending upon the compatibility of the two polymers with each other. As the spinning solution, there is preferred, rather than a uniform transparent solution, a cloudy uniform fine dispersion in which the high-melting PVA type polymer (A) is dissolved as a matrix (sea) phase and the low-melting water-soluble polymer (B) is finely dispersed as an islands phase. Of course, when the two polymers have good compatibility with each other, a uniform transparent solution is formed. When such a uniform transparent solution is used as a spinning solution, the conditions for preparation of spinning solution and the spinning conditions are selected so that the high-melting polymer (A) becomes an sea component, whereby the binder fiber of the present invention can be produced.

Specific examples of the solvent used in the process for production of the present fiber are polar solvents such as dimethyl sulfoxide (hereinafter abbreviated to DMSO), dimethylacetamide, N-methylpyrrolidone, dimethylimidazolidinone and the like; polyhydric alcohols such as glycerine, ethylene glycol and the like; strong acids such as nitric acid, sulfuric acid the like; concentrated solutions of a rhodanic acid salt, zinc chloride, etc.; and mixed solvents thereof. DMSO is particularly preferable in view of its low-temperature solvency, low toxicity, low corrosiveness, etc. When the two polymers are added to the above solvent and dissolved therein with stirring and there occurs phase separation, care is preferably taken so that stirring is made vigorously during dissolution in order to give rise to fine dispersion and, during standing for defoaming, slow-speed stirring is made in order not to invite aggregation, precipitation and foaming.

The viscosity of the spinning solution differs depending upon the spinning method used but is preferably 5–5,000 poises at a solution temperature of the vicinity of the nozzle during spinning. The concentrations of polymers and the temperature of spinning solution are controlled so that the spinning solution has a viscosity of, for example, 500–5,000 poises in the case of dry spinning, 80–800 poises in the case of dry-jet wet spinning and 5–200 poises in the case of wet spinning. The spinning solution may contain, besides the two polymers, a compatibilizer, a phase separation accelerator, etc. for controlling the formation of a sea-islands structure of the two polymers. The spinning solution may further contain other additives for particular purposes. Examples of the other additives are an antioxidant, a light stabilizer and an ultraviolet absorber for prevention of polymer deterioration; a pigment and a dye for coloring of fiber; a surfactant for control of surface tension; and a pH-adjusting acid or alkali for prevention of saponification reaction of partially saponified PVA.

Spinning of the spinning solution is conducted by dry spinning, dry-jet wet spinning or wet spinning. In the dry spinning, the spinning conditions are selected so that during the evaporation of the solvent, the high-melting polymer forms a matrix (a sea component) and the low-melting polymer forms islands; and the resulting fiber is wound up. In the dry-jet wet spinning, the spinning solution is discharged from a nozzle first into an inert gas layer (for example, an air layer) and then passed through a solidifying solution for solidification and extraction of solvent; as necessary, wet drawing and heat dry drawing are conducted; and the resulting fiber is wound up. In the wet spinning, the spinning solution is discharged from a nozzle directly into a solidifying solution for solidification and extraction of solvent; as necessary, wet drawing and heat dry drawing are conducted; and the resulting fiber is wound up. In any spinning method, the conditions for spinning solution preparation as well as the conditions for spinning must be selected so that the high-melting polymer forms a sea component and the low-melting polymers forms islands in the resulting fiber. For effective formation of such a sea-islands structure, it can be conducted specifically, for example, to make high the ratio of the high-melting polymer which is to become a sea component, or to select the conditions for spinning solution preparation and the conditions for spinning so that phase separation can take place easily.

In the present invention, uniformly solidified filaments are formed in the solidification step in order to obtain a fiber strength of 3 g/d or more. Uniform solidification can be confirmed by observing the cross section of a fiber after drawing with an optical microscope. That is, when a fiber shows no skin-core structure and shows a nearly circular cross section, the fiber is judged to be uniformly solidified.

Use, as a solidifying bath, of a concentrated aqueous Glauber's salt solution generally used in spinning of PVA results in nonuniform solidification; as a result, a skin-core structure is formed and the cross section of the fiber obtained becomes oval, making it impossible to conduct drawing and orientation sufficiently. Also, use of a spinning solution containing boric acid and, as a solidifying bath, an aqueous alkaline dehydration salt solution is not preferable because the partially saponified PVA is saponified during spinning and comes to have a higher melting point and lower water solubility. Meanwhile, each of alcohols (e.g. methanol and ethanol), ketones (e.g. acetone and methyl ethyl ketone), aliphatic esters (e.g. methyl acetate and ethyl acetate) and mixed solvents of one of said solvents and the same solvent as used in the spinning solution can solidify the high-melting PVA type polymer (which is to become a sea component). Therefore, when one of the above organic solvents is used as a solidifying bath, uniform solidification takes place and a fiber having a nearly circular cross section can be formed. This fiber can be sufficiently orientated and crystallized in the subsequent wet drawing and heat dry drawing and therefore can have a strength of 3 g/dr or more. Incidentally, the fiber cross section mentioned herein is a cross section as observed using an ordinary optical microscope. The temperature of the solidifying bath is preferably low (0°–10° C.) in order to obtain more uniform gel filaments. In the present invention, the solidifying bath need not be able to solidify the low-melting water-soluble polymer which is to become an islands component. Even if the low-melting polymer is soluble in the solidifying bath, spinning is possible. In this case, however, a weight ratio of the high-melting polymer and the low-melting polymer, of smaller than 6/4 is not preferable because the low-melting polymer dissolves in the solidifying bath or there arises fusion between filaments. Said ratio is preferably larger than 7/3. When the low-melting polymer is soluble in the solidifying bath, there is a tendency that the low-melting polymer and the solvent in the spinning solution move, during solidification, to a zone of each solidified filament close to the surface of the filament; as a result, the low-melting polymer is distributed more in the filament surface portion than in the filament center portion. Consequently, the resulting binder fiber has a heat-press bondability intended by the present invention, in spite of the lower content of the low-melting polymer. This is an unexpected merit.

Then, description is made on the nonwoven fabric using the present binder fiber.

According to the present invention, there is provided a dry laid nonwoven fabric or a wet laid nonwoven fabric each containing at least 10% of the present binder fiber mentioned above. This nonwoven fabric is heat-bondable by being heat-pressed at a temperature of 80°–240° C. at a linear pressure of 1 kg/cm or more or an areal pressure of 2 kg/cm$^2$ or more. A nonwoven fabric containing less than 10% of the binder fiber of the present invention is unable to have an adhesivity capable of withstanding the actual use, when heat-pressed under the above conditions. In order for the nonwoven fabric of the present invention to have a higher adhesivity, the content of the present binder fiber is preferably 20% or more, more preferably 30% or more. The nonwoven fabric of the present invention constituted by the present binder fiber alone or by the present binder fiber and other water-soluble fiber (e.g. a water-soluble PVA type fiber) is water-soluble and heat-press-bondable. This nonwoven fabric is heat-press-bondable when processed into a three-dimensional structure such as bag, pot or the like. The processing, being speedy and simple, having no public hazard, and being safe as compared with the conventional processing using a chemical adhesive, can greatly reduce the processing coat. The nonwoven fabric of the present invention can be made, by processing (heat-pressing), into a water-soluble three-dimensional structure, and this is an important characteristic of the present nonwoven fabric. The present nonwoven fabric, therefore, can effectively be used in various applications such as wash bag, laundry bag, water-disintegratable sanitary goods, water-disintegratable toilet goods, seed sheet, agricultural chemical bag, fertilizer bag, paper pot, root-wrapping material, water-soluble amusing goods and the like.

Also, the nonwoven fabric of the present invention, which comprises a hydrophilic but water-insoluble fiber such as PVA type fiber or cellulose fiber (e.g. viscose rayon, cupraammonium rayon, polynosic rayon, solvent-spun cellulose fiber obtained by dissolving in a solvent and depositing cellulose directly, cotton or hemp) and 10% or more of the present binder fiber, is heat-press bondable and can be processed into a three-dimensional structure by heat-pressing (this heat-pressing has the above-mentioned merits as compared with the conventional processing method using a chemical adhesive).

The characteristic of the present nonwoven fabric is that when it is processed into a three-dimensional structure by heat-pressing and the structure comes in contact with water or hot water, the heat-press-bonded portion of the structure loses the adhesivity and the structure returns to the shape of the nonwoven fabric before processing. Further, when the present nonwoven fabric is bonded between fibers by the utilization of the heat-press bondability of the present binder fiber, the three-dimensional structure formed from the nonwoven fabric by heat-pressing, when coming in contact with water or hot water, is disintegrated even into the PVA type fiber or cellulose fiber constituting the nonwoven fabric. In processing, for example, a nonwoven fabric containing a cellulose fiber, into a three-dimensional structure, there has conventionally been used a complicated process which comprises preparation of a chemical adhesive, coating of a given amount of said adhesive, drying and curing (in this process, bonding requires long time and leads to public hazards by the evaporation of the solvent.), or a process which comprises conducting heat bonding by the use of a hydrophobic heat-bonding fiber (in this process, bonding can be conducted speedily, easily and without causing any public hazard, but there is obtained no three-dimensional structure having spontaneous disintegrability such as possessed by a cellulose fiber.). Meanwhile, according to the processing by heat-press bonding (heat sealing) using the nonwoven fabric of the present invention, there can be produced a three-dimensional structure speedily, easily and without causing any public hazard even in an automated operational line; and the three-dimensional structure (e.g. paper pot, fertilizer bag, seed sheet or root-wrapping material), when buried in the soil or left on the soil, loses the adhesivity by the action of moisture or rain and is disintegrated into the base material (cellulose fiber). Thus, the nonwoven fabric of the present invention can be made into a three-dimensional structure friendly to the earth, inexpensively and without causing any public hazard.

There is no restriction with respect to the process for producing the present nonwoven fabric. A dry laid nonwoven fabric can be produced by passing, through a card or a random webber, staple fibers (obtained by crimping and cutting the present binder fiber) alone or a mixture of said staple fibers with water-soluble or water-insoluble PVA type staple fibers or cellulose staple fibers (e.g. rayon or polynosic rayon) and allowing the resulting web to have adhesion or intertwining between fibers by a needle punch method, a chemical adhesion method, a heat adhesion method or the like. Also, a wet laid nonwoven fabric (paper) can be produced by short-cutting the present binder fiber into pieces of 1–10 mm and making paper as necessary together with a pulp, a rayon, a PVA type fiber or the like. The nonwoven fabric (paper) is characterized by its heat-press bondability (heat sealability). When the present binder fiber has an in-water-cutting temperature of 50°–80° C. , paper making is preferably conducted by using a pulp, a rayon or a vinylon as a main fiber and the present binder fiber as a small-volume component. When the in-water-cutting temperature of the present binder fiber is 80°–100° C., it is preferable to use the present binder fiber as a main fiber. Thus, a heat-sealable PVA type fiber paper or a heat-sealable cellulose paper is obtained. Selection of dry method or wet method is appropriately made depending upon the requirements in the usage of the nonwoven fabric obtained. However, the preferable process for producing the present nonwoven fabric is a process which comprises heat-pressing a web containing at least 10% of the present binder fiber (which is heat-press-bondable), at a temperature of 80°–240° C. at a linear pressure of 1 kg/cm or more or an areal pressure of 2 kg/cm$^2$ or more. In the present invention, the temperature and a pressure used in heat pressing refer to a temperature and a pressure both of which a web undergoes actually, and do not refer to a set temperature and a set pressure. The actual temperature and pressure can be measured by the use of a thermo-indicating label, a pressure indicator or the like. A temperature of less than 80° C. and a linear pressure of less than 1 kg/cm or an areal pressure of less than 2 kg/cm$^2$ is not practical because the resulting adhesivity is not sufficiently high. A temperature higher than 240° C. is close to the melting point of the PVA type polymer (sea component) and use of such a temperature destroys the fiber structure which is orientated and crystallized, inviting reduction in fiber strength or shrinkage of fiber. The temperature and pressure used in heat pressing is preferably 100°–220° C. and 2–100 kg/cm (linear pressure) or 5–200 kg/cm$^2$ (areal pressure), more preferably 130°–210° C. and 5–50 kg/cm (linear pressure) or 10–100 kg/cm$^2$ (areal pressure) in view of the resulting adhesivity and the strength and dimensional stability of fiber after heat pressing.

The nonwoven fabric produced by heat-pressing a web consisting of the present binder fiber alone, or a web consisting of a water-soluble PVA type and 10% or more of the present binder fiber, is water-soluble and very useful as a chemical lace base fabric. In conventional production of a chemical lace base fabric, two steps, i.e. a step of imparting an adhesive and a step of drying or curing for expression of adhesivity are essential and further at least one minute is necessary for drying or curing, which requires a large amount of investment for apparatus; moreover, the line speed must be suppressed to secure an intended quality, making impossible high-speed production. Furthermore, the adhesive used or its deterioration product sticks to the apparatus for production of chemical lace base fabric, during from the step of imparting the adhesive to the step of drying and curing; this allows the nonwoven fabric to have defects and the operation of the apparatus must be stopped to clean and remove the adhesive or its deterioration product sticking to the apparatus. Meanwhile in production of a chemical lace base fabric by using the process for production of the present nonwoven fabric, adhesion is conducted by heat pressing and is complete in 3 seconds or less by simply passing a web through a hot calender roll, whereby a chemical lace base fabric can be produced speedily and easily. Moreover, since no adhesive is used, there is no sticking of adhesive or its deterioration product to apparatus; the resulting nonwoven fabric has no defects; accordingly, there is no need of stopping the operation of apparatus to clean and remove the adhesive or its deterioration product sticking to the apparatus. Use of the present binder fiber has made it possible for the first time to produce a water-soluble nonwoven fabric by heat-pressing and yet speedily, easily and without causing any public hazard.

In producing a nonwoven fabric by heat-pressing a mixed material of (a) a base fiber material, i.e. a water-insoluble PVA type, a cellulose fiber (e.g. rayon), a polyamide fiber (e.g. nylon-6), a polyolefin fiber, a polyester fiber or a mixture thereof and (b) 10% or more of the present binder fiber, the product of interior quality, the off-specification product (these appear during the production of nonwoven fabric), the refuses from trimming, etc. are disintegrated into the starting material fibers when contacted with water or hot water; therefore, the recovery, reclamation and reuse of the base fiber material is possible. Meanwhile in producing a nonwoven fabric by conventional heat pressing, the recovery, reclamation and reuse of the product of inferior quality and the refuses (e.g. refuses from trimming) (broke in the case of wet process) has been impossible and they must have been incinerated. Thus, use of the binder fiber of the present invention has made possible the utilization of heat-pressing as well as the recovery, reclamation and reuse of the base fiber material.

In the present invention, the definitions of parameters and the methods for measurement thereof are as follows.

1. Melting point

A sample polymer (10 mg) is heated at a rate of 20° C./min in a nitrogen atmosphere by the use of a differential scanning calorimeter (DSC-20, a product of Mettler Co.). A temperature at which the sample polymer shows an endothermic peak during the heating, is taken as the melting point of the sample polymer.

2. Number and positions of islands

A fiber is coated with an appropriate resin such as paraffin or the like; the resulting fiber is cut by the use of a microtome or the like to prepare an ultrathin sectional slice; as necessary, the slice is dyed appropriately; the dyed slice is observed for the number and positions of islands in a state that the islands component is observed best, by the use of an optical microscope, a scanning electron microscope, a transmission electron microscope or the like.

3. Fiber strength

A single filament sample of 20 mm in length is subjected to a tensile test (rate of pulling=50%/min) in accordance with JIS L 1015.

4. Complete-water-dissolution temperature

A fiber (50 mg) is immersed in 100 cc of water; the water is heated at a temperature elevation rate of 1° C./min with stirring; and there is measured a temperature at which the fiber dissolves completely in water with no gel remaining.

The present invention is hereinafter described specifically by way of Examples. The present invention, however, is not restricted to the Examples. In the Examples, % is by weight unless otherwise specified.

EXAMPLE 1

A PVA (polymerization degree=1,700, saponification degree =98.5 mole %, melting point=225° C.) and a PVA (polymerization degree=600, saponification degree=73 mole %, melting point=173° C.) were dissolved in DMSO of 90° C. in a nitrogen atmosphere with stirring so that their concentrations became 15% and 5%, whereby a spinning solution was prepared. The weight ratio of the high-melting PVA type polymer and the low-melting water-soluble polymer in the spinning solution was therefore 75/25. The spinning solution was a semi-cloudy dispersion of good spinnability and, when allowed to stand at 90° C. for 8 hours, did not separate into two phases and was stable.

The spinning solution was wet-spun into a solidifying bath of 3° C. consisting of 70% of methanol and 30% of DMSO, through a nozzle having 500 orifices each of 0.08 mm in diameter. The resulting solid filaments were white and cloudy and, in these filaments, the two PVAs were presumed to be present in separate phases. The filaments were subjected to wet drawing of 5.0-fold by the use of a wet-drawing bath consisting of methanol; the wet-drawn filaments were immersed in a methanol bath to remove the DMSO in each filament by extraction; the resulting filaments were endowed with a textile oil of mineral oil type, then dried at 100° C., and subjected to heat dry drawing at 215° C. so that the total draw ratio became 13-fold. The thus obtained filaments (1,000 dr/500 f) had no fusion between each other and had an complete-water-dissolution temperature of 71° C. Each filament had a strength of 9.3 g/dr. Observation of filament section indicated that there was formed a sea-islands structure comprising, as the sea component, the high-melting PVA having a saponification degree of 98.5 mole % and, as the islands component, the low-melting PVA having a saponification degree of 73 mole %, that a large number of islands were present in a filament zone 0.01–2 μm inside from the filament surface and the total number of islands was at least 100, and that the islands component was not substantially exposed on the filament surface. Also, examination by an optical microscope indicated that the section of each filament had no skin-core structure and had a circular shape and a uniform structure.

The above filaments were made into staple fibers; the staple fibers were subjected to carding to prepare a web of 30 g/m$^2$; and the web was subjected to a hot calender roll treatment under the heat-pressing conditions of 190° C. (temperature), 60 kg/cm (linear pressure) and 1 second or less (treating time). In the calender treatment, there was no substantial change in dimension. The thus obtained nonwoven fabric showed good adhesion between filaments, was not disintegrated into single filaments when crumpled by hand, and showed a breaking length of 5.3 km (longitudinal direction) and 1.6 km (transverse direction). This was a strength capable of sufficiently withstanding the actual use as a chemical lace base fabric. The nonwoven fabric after heat-press bonding was completely soluble in boiling water.

Comparative Example 1

Only the same high-melting PVA as used in Example 1, having a polymerization degree of 1,700, a saponification degree of 98.5 mole % and a melting point of 225° C. was dissolved in DMSO in the same manner as in Example 1 so that the PVA concentration became 17%, whereby a uniform transparent spinning solution was prepared. The spinning solution was subjected to spinning and drawing in the same manner as in Example 1. The resulting solid filaments were nearly transparent and showed neither cloudiness nor phase separation unlike the case of Example 1. Upon observation of the section of filament, the section had a uniform structure and a circular shape but no sea-islands structure was seen therein. In the same manner as in Example 1, the filaments were made into staple fibers and subjected to carding to prepare a web, and the web was subjected to heat pressing. The resulting nonwoven fabric appeared as if being bonded between filaments but, when crumpled by hand, was disintegrated into single filaments and showed a breaking length of only 0.4 km (longitudinal direction) and 0.1 km (transverse direction).

Comparative Example 2

Only the same low-melting PVA as used in Example 1, having a polymerization degree of 600, a saponification degree of 73 mole % and a melting point of 173° C. was dissolved in DMSO in the same manner as in Example 1 so that the PVA concentration became 30%, whereby a transparent spinning solution was prepared. It was tried to spin the spinning solution in the same manner as in Example 1. However, the spinning solution was not solidified in the solidifying bath consisting of 70% of methanol and 30% of DMSO and could not be spun. The solution was not solidified even in a solidifying bath consisting of methanol alone and could not be spun. However, spinning was possible when the solidifying bath was changed to 100% acetone and both the wet-drawing bath and the extraction bath were also changed to acetone. The solid filaments were subjected to wet drawing of 4.5-fold and dried at 80° C. The thus obtained solid filaments were nearly transparent; there was no fusion between filaments; and the section of filament had a uniform structure and a circular shape but no sea-islands structure was seen therein. In the same manner as in Example 1, the filaments were made into staple fibers and subjected to carding to prepare a web, and the web was heat-pressed. During the heat pressing, the web shrank to a size of less than half, and the web after heat pressing had a coarse hand and was unusable as a nonwoven fabric although there was seen good bonding between filaments.

Comparative Example 3

The same PVA as used in Example 1, having a polymerization degree of 1,700, a saponification degree of 98.5 mole % and a melting point of 225° C. and the same PVA as used in Example 1, having a polymerization degree of 600, a saponification degree of 73 mole % and a melting pint of 173° C. were separately dissolved in DMSO so that the respective concentrations became 23% and 38%, whereby two spinning solutions were prepared. The two spinning solutions were passed through respective pipes and gear pumps and then were discharged from a core-sheath nozzle pack having 24 orifices each of 0.2 mm in diameter (in this nozzle pack, the sheath was for the high-saponification degree PVA solution). In this case, the rotational number of each gear pump was set so that the core/sheath ratio became 60/40. Spinning was conducted by a dry-jet wet spinning which comprised passing the discharged streams of spinning solution through an air gap of 8 mm and then passing the same through a solidifying bath as in Example 1. After the spinning, there were conducted wet drawing, extraction, oiling, drying and heat dry drawing in the same manner as in Example 1, to obtain a bicomponent fiber which had the low-saponification degree PVA as a core in the center (that is, the fiber had one island). In the same manner as in Example 1, the fiber was made into staple fibers and subjected to carding to prepare a web, and the web was subjected to a heat-pressing treatment. The resulting nonwoven fabric appeared as if being bonded between fibers but, when crumpled by hand several times, showed peeling of fibers. The strength of the nonwoven fabric was larger than that of Comparative Example 1 but smaller than that of Example 1. As appreciated from above, the core-sheath bicomponent fiber of the present Comparative Example in which the number of islands is one and a thick (4 μm) sea component phase was present at the fiber surface, had a low heat-press bondability owing to the presence of a low-melting polymer at the core portion only.

EXAMPLE 2

A PVA having a polymerization degree of 1,750, a saponification degree of 93.5 mole % and a melting point of 212° C. , and a modified PVA (modified with 1 mole % of allyl alcohol) having a polymerization degree of 400, a saponification degree of 60 mole % and a melting point of 162° C. were mixed at a weight ratio of 80/20. The mixture was dissolved in DMSO in a nitrogen atmosphere at 90° C. with stirring so that the total PVA concentration became 19%, whereby a spinning solution was prepared. This spinning solution was a cloudy but stable dispersion and, when allowed to stand for 8 hours, showed no separation into two phases by aggregation.

The spinning solution was discharged through a nozzle having 1,000 orifices each of 0.08 mm in diameter and solidified and then subjected to wet drawing, extraction, oiling and drying in the same manner as in Example 1. Then, heat dry drawing was conducted at 120° C. so that the total draw ratio became 5.3-fold, whereby filaments of 1,800 d/1,000 f were obtained. The filaments had no fusion between each other and had an complete-water-dissolution temperature of 10° C. and a strength (single filament) of 4.2 g/dr. Observation of filament section indicated that the modified PVA formed an islands component, that a large number of islands were present in a filament zone 0.01–2 μm inside from the filament surface and the number of islands was at least 100, that substantially no islands component was exposed on the filament surface, and that the filament section had no skin-core structure and had a uniform structure and a circular shape.

A fiber obtained by cutting the above filaments to a length of 3 mm, VPB-102 (as a main fiber) and VPB-105 (as a binder fiber) were dispersed in water at a weight ratio of 40/50/10. The aqueous dispersion was passed through a Tappi paper-making machine and the resulting material was dehydrated and drum-dried to obtain a paper of 30 g/m$^2$. The paper was subjected to heat-sealing at the both sides by the use of Poly-sealer (a product of Fuji Impulse Co., Ltd.). The heat-sealed paper had, at the sealed portion, an adhesivity which was distinctly superior to that of a paper obtained by subjecting a 90/10 (by weight) mixture of VPB-102 and VPB-105 to the same paper making, drying and heat-sealing as above. The sealing temperature and pressure were presumed to be 170° C. and 2 kg/cm. Incidentally, VPB-102 is a heat-drawn fiber of 1.0 denier being insoluble in boiling water and consisting of a PVA having a polymerization degree of 1,700 and a saponification degree of 9.9 mole %, produced by KURARAY CO., LTD.; and VPB-105 is a nondrawn fiber of 1.0 denier being soluble in water of 70° C. and consisting of a PVA having a polymerization degree of 1,700 and a saponification degree of 98.5 mole %, also produced by KURARAY CO., LTD.

EXAMPLE 3

A PVA having a polymerization degree of 1,700, a saponification degree of 97.2 mole % and a melting point of 220° C., and a PVA having a polymerization degree of 2,000, a saponification degree of 70 mole % and a melting point of 171° C. were mixed at a weight ratio of 9/1. The mixture was dissolved in DMSO in the same manner as in Example 1 so that the total PVA concentration became 20%, whereby a spinning solution was prepared. The spinning solution was slightly cloudy but showed no phase separation by aggregation. The spinning solution was subjected to wet spinning in the same manner as in Example 1 and then to heat dry drawing at 210° C. so that the total draw ratio became 14-fold, whereby filaments of 2,500 d/1,000 f were obtained. The filaments had no fusion between each other and had an complete-water-dissolution temperature of 48° C. and a strength (single filament) of 8.7 g/dr. Observation of filament section indicated that the PVA having a saponification degree of 70 mole % formed an islands component, that a large number of islands were present in a filament zone 0.01–2 μm inside from the filament surface and the number of islands was at least 100, that substantially no islands component was exposed on the filament surface, and that the filament section had no skin-core structure and had a uniform structure and a circular shape. In the present Example, as compared with the case of Example 1, the concentration and whitishnesses of the spinning solution and the solidified filaments were lower and the separated phases were more finely dispersed; and therefore the number of islands was presumed to be larger.

The above filaments were made into staple fibers; the staple fibers were subjected to carding to prepare a web of 30 g/m$^2$; and the web was subjected to a hot calender roll treatment under the heat-pressing conditions of 160° C. (temperature), 20 kg/cm (linear pressure) and 1 second or less (treating time). In the calender treatment, there was no substantial change in dimension. The thus obtained nonwoven fabric showed good adhesion between filaments, was not disintegrated into single filaments when crumpled by hand, and showed a breaking length of 5.1 km (longitudinal direction) and 1.3 km (transverse direction). This was a strength capable of sufficiently withstanding the actual use as a chemical lace base fabric. The nonwoven fabric after heat-press bonding was completely soluble in hot water of 60° C. Two sheets of the above nonwoven fabric were piled up and heat-sealed at the three sides by the use of Poly-sealer (a product of Fuji Impulse Co., Ltd.), whereby a bag-like material was produced. The heat-sealed portion of the bag produced by heat sealing alone had such an adhesivity as the two original sheets could not be separated from each other easily by hand. The bag was soluble in hot water of 70°C.

Comparative Example 4

Spinning and drawing were conducted in the same manner as in Example 1 except that a polyacrylic acid having a polymerization degree of 400 was used as an islands component, whereby a PVA-polyacrylic acid mixed fiber was obtained. The fiber, when allowed to stand in boiling water of 100° C. for 30 minutes, caused considerable swelling and became a gel-like fiber of very low strength but was not soluble completely. This phenomenon is presumed to be caused by formation, during fiber production, of a three-dimensional crosslinked structure as a result of the reaction of the PVA and the polyacrylic acid. Such a fiber has a so-called water-dissolution temperature (a temperature of fiber at which when the fiber is immersed in water with a given load applied to the fiber and the temperature of the water is increased, the fiber causes breaking of 100° C. or less, but has a complete-water-dissolution temperature (used herein) of higher than 100° C. Such a fiber, which is not soluble in water completely and remains in the form of a gel, is unusable for production of, for example, a chemical lace base fabric which must be soluble in water completely.

EXAMPLE 4

The staple fibers obtained in Example 3 (20%) and rayon staple fibers of 2 d (80%) were mixed. The mixture was subjected to carding to prepare a web of 40 g/m$^2$. The web was subjected to a hot calender roll treatment under the heat-pressing conditions of 180° C. (temperature), 20 kg/cm (linear pressure) and 1 second or less (a treatment time). There was no substantial change in dimension during the calender treatment. The nonwoven fabric obtained had good adhesion between fibers and was not disintegrated into single fibers when crumpled by hand. When the product of inferior quality and the refuses from trimming all appearing during the production of the nonwoven fabric were immersed in water of 70° C., the strength possessed by the nonwoven fabric was almost lost and the recovery of rayon staple fibers was possible.

The above statement is summarized below. The binder fiber of the present invention is produced by mixing a high-melting high saponification degree PVA-type polymer and a low-melting water-soluble polymer in a solvent of the above high-melting polymer then subjecting the mixture to spinning for low-temperature uniform solidification, and is characterized by having a structure in which the high-melting PVA type polymer is a sea component (matrix) and the low-melting water-soluble polymer is an islands component and in which the low-melting water-soluble polymer is not present on the fiber surface but present in a fiber zone very close to the surface. As mentioned above, in the present binder fiber, the low-melting heat-bondable polymer as islands component is present in the high-melting high saponification degree PVA as sea component (matrix), and the sea component (matrix) is highly orientated and crystallized. Because of such a structure, the present binder fiber has dimensional stability even under high humidity and can be used as an ordinary fiber under ordinary conditions; however, when the present fiber is heat-pressed, the matrix phase portion at the surface is broken and the low-melting polymer (islands component) is pushed out onto the fiber surface, and there takes place adhesion between filaments. Since there is no melting of the high-melting PVA polymer phase (matrix) during the heat pressing, there is substantially no dimensional change and a high strength can be maintained even after the heat pressing.

The binder fiber of the present invention is a PVA fiber having water solubility, heat-press bondability and a high strength. Owing to the heat-press bondability, the present fiber can produce a nonwoven fabric easily and without causing any public hazard. For example, a chemical lace base fabric, which has hitherto been produced by coating an aqueous solution of PVA type sizing agent and then drying the coated web, can be produced from the present binder fiber at a far higher productivity. Further, the nonwoven fabric produced from the present binder fiber by a dry method or a wet method has a heat-press bondability and can be processed, by heat sealing, into three-dimensional structures (e.g. bag, pot and box) efficiently and speedily. Furthermore, when a nonwoven fabric is produced, by heat pressing, from a mixture of the present binder fiber and a hydrophilic material (e.g. PVA type fiber or rayon), the product of inferior quality, the off-specification product, the refuses from trimming, etc. all appearing during the production of said nonwoven fabric are soluble in water or hot water and the hydrophilic material (e.g. PVA type-fiber or rayon) can be recovered for reuse by contact with water or hot water.

What is claimed is:

1. A water-soluble heat-press-bonding polyvinyl alcohol-containing binder fiber of a sea-islands structure, having a complete-water-dissolution temperature of 100° C. or less such that said fiber completely dissolves in water at said temperature and a tensile strength of 3 g/d or more, in which structure, the sea component is a water-soluble polyvinyl alcohol polymer (A) and the islands component is a water-soluble polymer (B) having a melting point or a fusion-bonding temperature each at least 20° C. lower than the melting point of the polymer (A), and wherein at least part of the islands component in said fiber is present in a fiber zone from 0.01 to 2 μm inside from the fiber surface, said water-soluble polyvinyl alcohol (A) having a saponification degree of 90.0–99 mol % and being comprised of vinyl alcohol units which may be modified with 0.1–3 mol % of a comonomer modifying unit.

2. A binder fiber set forth in claim 1, wherein the number of islands in fiber cross section is at least 5.

3. A binder fiber set forth in claim 1, wherein the fiber cross section has a uniform structure.

4. A binder fiber set forth in claim 1, wherein at least part of the islands component is present in a fiber zone from 0.01 to 1 μm inside from the fiber surface.

5. A binder fiber set forth in claim 1, wherein the polymer (A) is a hot-water-soluble polyvinyl alcohol polymer having a melting point of 200°–230° C.

6. A binder fiber set forth in claim 1, wherein the polymer (A) is a polyvinyl alcohol polymer having a polymerization degree of 500–24,000 and a saponification degree of 92–99 mole % or said polyvinyl alcohol polymer modified with a comonomer unit by 0.1–3 mole %, and the polymer (B) is a polyvinyl alcohol polymer having a polymerization degree of 50–4,000 and a saponification degree of 50–92 mole % or said polyvinyl alcohol polymer modified with a comonomer unit by 3–10 mole %.

7. A binder fiber set forth in claim 1, having a tensile strength of 5 g/d or more.

8. A binder fiber set forth in claim 1, wherein the polymer (B) has a melting point or a fusion-bonding temperature each lower by at least 30° C. than the melting point of the polymer (A).

* * * * *